United States Patent [19]

Steele

[11] Patent Number: 4,913,591

[45] Date of Patent: Apr. 3, 1990

[54] MOBILE MARINE PLATFORM AND METHOD OF INSTALLATION

[75] Inventor: James E. Steele, Beaumont, Tex.

[73] Assignee: Bethlehem Steel Corporation, Bethlehem, Pa.

[21] Appl. No.: 258,466

[22] Filed: Oct. 17, 1988

[51] Int. Cl.[4] ..... B63B 35/44; E02B 17/00

[52] U.S. Cl. ..... 405/196; 405/201; 405/224; 114/265

[58] Field of Search ..... 405/195, 196, 198, 199, 405/200, 201, 202, 203, 205, 207, 224, 227; 114/264, 265

[56] References Cited

U.S. PATENT DOCUMENTS

| | | | |
|---|---|---|---|
| 3,294,051 | 12/1966 | Khelstovsky | 114/0.5 |
| 3,967,458 | 7/1976 | Scales | 405/196 |
| 4,041,711 | 8/1977 | Lucas | 405/199 X |
| 4,062,313 | 12/1977 | Stram | 114/265 |
| 4,468,157 | 8/1984 | Horton | 405/224 |
| 4,516,882 | 5/1985 | Brewer et al. | 405/224 |
| 4,583,881 | 4/1986 | Steele | 405/198 |
| 4,668,127 | 5/1987 | Steele | 405/198 |
| 4,702,648 | 10/1987 | Stageboe et al. | 405/224 |
| 4,740,109 | 4/1988 | Horton | 405/224 |
| 4,784,529 | 11/1988 | Hunter | 405/227 |

OTHER PUBLICATIONS

Bethlehem Marine Construction Group, Seatower Platforms, publication date not known.

Howe R. J., "The History and Current Status of Offshore Mobile Drilling Units", Ocean Industry, Jul. 1968.

Chou, F. S. F., et al., "Conceptual Design Process of a Tension Leg Platform", The Society of Naval Arcaitects & Marine Engineers, Annual Meeting, Nov. 1983.

Rechtin, C. C. et al., "Engineering Problems Related to the Design of Offshore Mobile Platforms", The Society of Naval Archetects & Marine Engineers Annual Meeting, Nov. 14–15, 1957.

Breuer, J. H. et al., "Tension Leg—Platform Will Get At—Sea Test Next Year," Oil & Gas Journal, Oct. 8, 1973.

Paulling, J. R. et al., "Analysis of the Tension Leg Platform", Society of Petroleum Engineers Journal, Sep. 1971.

Howe, R. J., "Evolution of Off Shore Drilling and Production Technology", 18th Annual Off Shore Technology Conference, Houston, Tex., May 5–8, 1986.

"Concrete TLP Stated for Heidrum Field," Ocean Industry, Apr. 1988.

Miener, B., "TLP Theoryfulfilling Expectations", Offshore, Jan. 1985.

"Computer Design Coupling Keeps TLP Level", Offshore, Jan. 1985.

(List continued on next page.)

*Primary Examiner*—David H. Corbin

*Attorney, Agent, or Firm*—Shlesinger & Myers

[57] ABSTRACT

A mobile marine drilling assembly has a horizontally disposed pontoon which floats on or is submerged below the surface of a marine environment. A first vertically disposed column is secured to the pontoon and extends upwardly therefrom. A work platform has an opening through which the column extends, and the platform overlies the pontoon and is vertically movable relative thereto along the column. A jack system is operably connected with the work platform and with the column for jacking the work platform along the column between a first position wherein the pontoon floats on the surface of the marine environment and a second position wherein the pontoon is disposed a substantial distance below the surface of the marine environment. An anchor is secured to the floor of the marine environment. A plurality of resilient tendons extend between and are secured to the pontoon and the anchor, and the tendons are under tension when the pontoon is in the second position so that wave and current induced horizontal movement of the pontoon and thereby of the column and the work platform is permitted, and vertical movement is resisted.

37 Claims, 6 Drawing Sheets

OTHER PUBLICATIONS

"Riser Capability Critical of TLP Operations," Offshore, Jan. 1985.
Murdock Advertisement, "If a Moored Deepwater Platform is Your Engineering Problem, The Lockseal Flexjoint is Your Answer".
"TLP Design Engineered for Careful Crest Control," Ocean Industry, Jun. 1988.
"Bundled TLP Tendons Easier to Enstoll," Offshore, Jul. 1988.
Crawford, D., "State of the At in Exotic Platforms," Offshore, Apr. 1979.
Langeivis, C., "The Gulf of Mexico Newest Proving Ground for Deepwater Technology", Ocean Industry, Apr., & May 1987.
Steven, R. R. et al., "Plans Set for TLP Debut," Offshore, Mar. 1980.
"Deepwater TLP Development in Norwegian Shelf Taking Place", Ocean Industry, Nov. 1987.
"TLP Unit Designed for Gas Liquefaction," Offshore, May 1988.
"Modularized Tensioners Hold TLWP Risers", Offshore, May 1988.
McCabe, C., "US Gulf Poised for Deepwater Surge," Ocean Industry, May 1988.
"Concrete TLP with Storage Recommended for Heidrun", Marine Engineering, Offshore, Nov. 1987.
LeBlanc, L. A., "Advanced Technology", Offshore, Aug. 1987.
"Tension Moored Platforms for the Gulf of Mexico", Ocean Industry, Jan. 1984.
LeBlanc, L. A., "Marine Engineering," Offshore, Jul. 1987.
LeBlanc, L. A., "Marine Engineering", Offshore, May 1987.
Littleton, J., "Marine Engineering", Offshore, Jul. 1988.
"Deepwater TLP Project Enters New Phase," Ocean Industry, Jul. 1988.

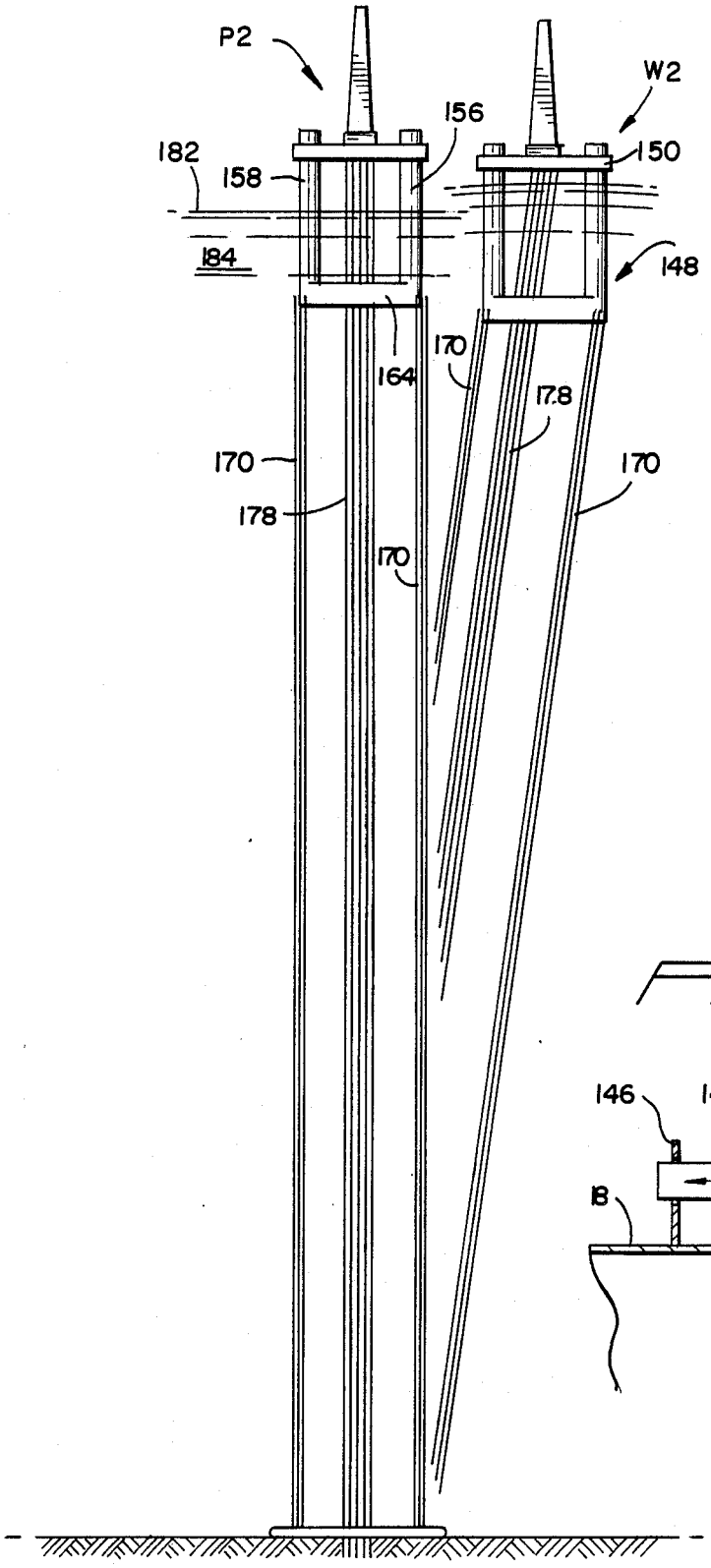
FIG 14
FIG 15
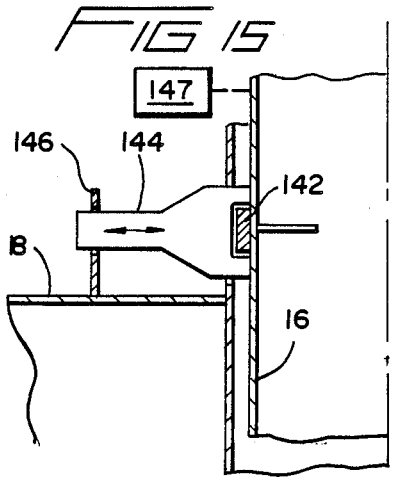

MOBILE MARINE PLATFORM AND METHOD OF INSTALLATION

BACKGROUND OF THE INvENTION

A tension leg platform, or TLP, is a marine platform having economic potential for use in drilling in deep water locations. A typical tension leg platform is similar to a semi-submersible platform by having a number of large, vertical cylinders close to the periphery for providing stability during the transportation phase from shore to the drill site. The platform has a lower structure tieing the cYlinders together at the bottom thereof in order to provide some buoyancy. It also has an upper structure tieing the upper ends together, and providing space for equipment, supplies and the like.

At the drill site, the tension leg platform is connected by a plurality of tendons to a heavy anchor secured on the sea bottom. The tendons are vertically oriented, and are always under tension. The tendons are quite slender and flexible, and act essentially as strings to permit the tension leg platform to move relatively freely in the horizontal plane while substantially preventing upward and angular movement. The tension leg platform provides considerable advantage over a semi-submersible platform, because the wellhead may be above water and drilling and work over may be done in the conventional surface fashion.

The hydrodynamic behavior of a tension leg platform has certain characteristics during the construction and installation phase which are at odds with the characteristics desired in the on-location phase. These characteristics impose conflicting design requirements. When on-location, it is desirable to reduce the vertical wave forces as much as possible, and thereby to reduce the strength, weight, number and cost of the tendons and the anchor. In order for this to be done, the buoyancy should be well below the surface of the water. Thus the cylindrical columns should be as deep in the water and as small in diameter as possible. Such a configuration, however, results in a very tall structure which is unstable when floating to location, and also has excessive draft during construction. Stability while floating to location is an absolute requirement, with the result that the goal of minimizing the on-location wave forces is normally sacrificed.

A further limitation on the prior art tension leg platform has to do with the buoyancy effect resulting from wave motion. Passage of a wave beyond a column causes that portion of the column normally disposed above the sea surface to be covered, thereby increasing the buoyancy thereof. Those portions normally disposed below the sea surface, on the other hand, suffer from reduced buoyancy when this occurs, on account of the motion of the water particles resulting from the cyclic nature of the wave. The net result is that the buoyancy may be adversely affected by wave action, particularly by waves of substantial amplitude.

The disclosed invention is one which overcomes the conflicting design requirements normally presented by a tension leg platform. The disclosed invention combines the advantages of a jack-up drilling platform with those of a tension leg platform in order to provide a mobile marine platform which has a first geometry during the construction phase and a second geometry during the on-location phase. In the first geometry the work platform is closely spaced to a pontoon system floating on the surface of the water and with the pontoon system substantially providing stability because no tendons are connected. In the second geometry, the work platform is spaced a substantial distance above the pontoon on a column carried by the pontoon and stability is substantially provided by the tendons connected to the anchor. The dimensions resulting from this two geometry system permit columns that are much smaller in diameter and extend to a much deeper operating draft than heretofore possible.

A further advantage of the invention involves the relationship between the buoyancy provided by the column and that provided by the pontoon. It is theoretically possible to size the two elements so that the theoretical wave forces cancel. The disclosed invention permits such dimensional configurations to be more easily taken into account, with the result that full advantage can be obtained of this phenomenon.

OBJECTS AND SUMMARY OF THE INVENTION

The primary object of the disclosed invention is a mobile marine platform having optimum stability during the construction and transportation phases, as well as optimum stability during the on-location phase. A further objective of the invention is a method for shifting the mobile drilling platform from the first geometry, which is suitable for the construction phase, to a second geometry, suitable for the on-site phase. An intermediate geometry may be used during transportation.

Yet a further object of the disclosed invention is a method for connecting the tendons of the mobile platform to a marine anchor secured to the sea floor.

A mobile marine platform according to the invention comprises horizontally disposed pontoon means for floating on or being submerged below the surface of a marine environment. At least a first vertically disposed column is secured to the pontoon means and extends upwardly therefrom. A work platform has at least a first opening through which the column extends, and the work platform overlies the pontoon means and is vertically movable relative thereto along the column. Jack means are operably associated with the work platform and with the column for jacking the work platform relative to the column between a first position wherein the pontoon means float on the surface of the marine environment, and a second position wherein the pontoon means are disposed a substantial distance below the surface of the marine environment. An anchor is provided for being secured to the floor of the marine environment. A plurality of resilient tendons are provided for extending between the pontoon means and the anchor means, and the tendons are under tension when the pontoon means are in the second position so that wave and current induced horizontal movement of the pontoon means and thereby of the column and work platform is permitted and upward and angular movement thereof is resisted.

A well drilling assembly comprises a floating platform comprising pontoon means submerged below the surface of a marine environment, at least a first vertically disposed column is secured to the pontoon means and extends upwardly therefrom and terminates above the marine environment surface, a work platform has at least a first opening through which the column extends and the platform overlies the pontoon means and is movable along the column relative thereto, and jack means are operably associated with the platform and with the column for jacking the platform relative to the column between a first position wherein the pontoon means float on the marine environment surface and a second position wherein the pontoon means are submerged therebelow. An anchor means is secured to the floor of the marine environment, and a plurality of resilient tendons extend under tension between and are secured to the anchor means and the pontoon means so that wave and current induced horizontal movement of the platform is permitted and upward and angular movement thereof is resisted.

A jack-up tension leg platform comprises a generally horizontally disposed pontoon means for floating on or being submerged below the surface of a marine environment, and the pontoon means are X-shaped in plan. A first vertically disposed cylindrical column is secured centrally to the pontoon means and extends upwardly therefrom. A work platform has a central opening therethrough and through which the column extends, and the work platform overlies the pontoon means and is vertically movable relative thereto along the column. Jack means are operably associated with the work platform and with the column for jacking the work platform between a first position wherein the pontoon means float on the surface of the marine environment and a second position wherein the pontoon means are submerqed therebelow.

The method of assembling a tension leg platform comprises the steps of providing a well drilling platform comprising pontoon means floating on the surface of a marine environment, at least a first vertically disposed column is secured to the pontoon means and extends upwardly therefrom, a work platform has at least a first opening through which the column extends and the work platform is movable along the column, and jack means are operably associated with the work platform and with the column for jacking the column relative to the work platform between a first position wherein the pontoon means float on the surface of a marine environment and a second position wherein the pontoon means are submerged therebelow, an anchor means is secured to the floor of the marine environment, and a plurality of resilient tendons are provided. Each of the tendons is secured to the pontoon means so that the tendon means are suspended therefrom in the marine environment and terminate a selected distance above the anchor means. The column is jacked relative to the work platform and thereby causes the tendons to terminate at or below the anchor means. The tendons are connected to the anchor means and the buoyancy of the platform is increased, thereby causing the platform to rise relative to the floor of the marine environment so that a tension is applied to the tendons.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein:

FIG. 14 is a schematic elevational view of the platform of FIG. 11 in a second geometry and with the platform in the vertical and horizontally displaced modes; and, FIG. 15 is a fragmentary cross-sectional view disclosing an alignment system used with the platform of FIG. 1.

DETAILED DESCRIPTION OF THE INvENTION

Figure 1:
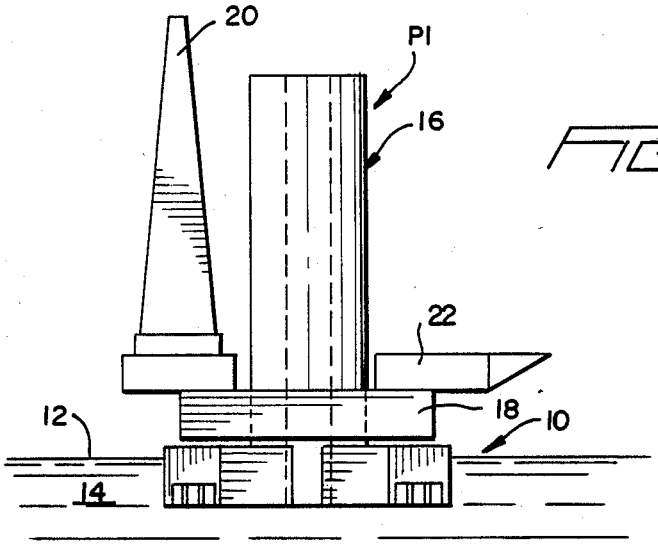
FIG. 1 is a schematic elevational view of a first embodiment of the mobile marine drilling platform of the invention disposed in a first geometry while floating on the surface of a marine/environment.

Mobile marine well drilling platform P1, as best shown in FIG. 1, comprises a pontoon assembly 10 floating on the surface 12 of marine environment 14. Cylindrical column 16 is secured to pontoon assembly 10 and extends upwardly therefrom. Work platform 18 is mounted above pontoon assembly 10 and about Column 16 on account of opening 19 and is longitudinally movable relative thereto. Derrick 20 is mounted to work platform 18 adjacent column 16, while quarters 22 are positioned on work platform 18 on an opposite side thereof adjacent to column 16. Derrick 20 is movable on rails 21.

Figure 3:
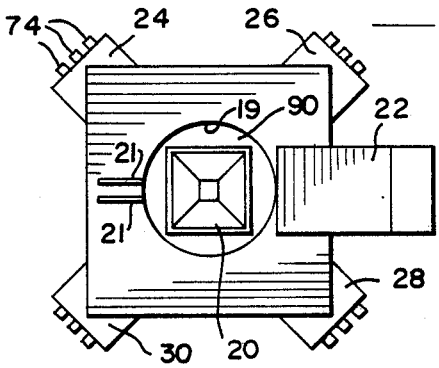
FIG. 3 is a top plan view of the platform of FIG. 1 in the on-location phase.
Figure 4:
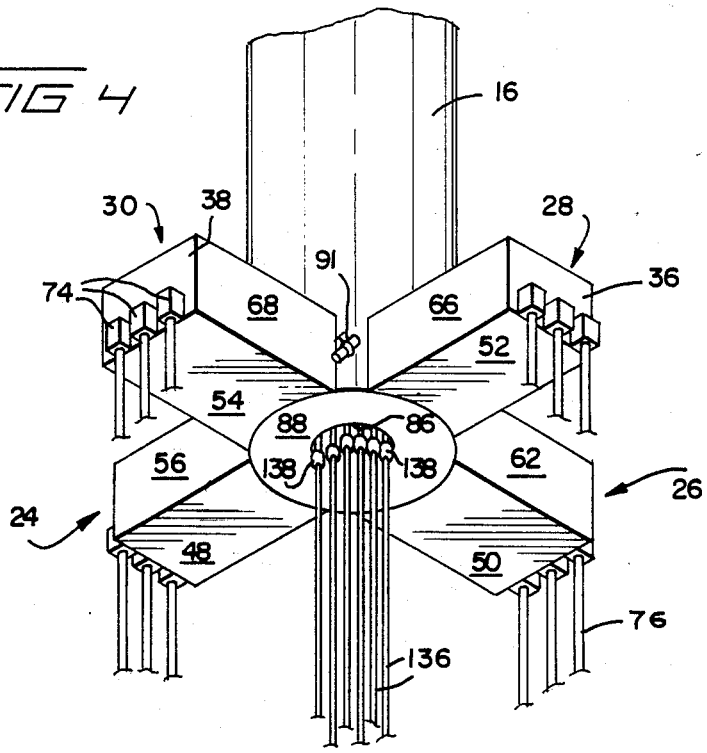
FIG. 4 is a fragmentary bottom perspective view of the platform of FIG. 3.
Figure 9:
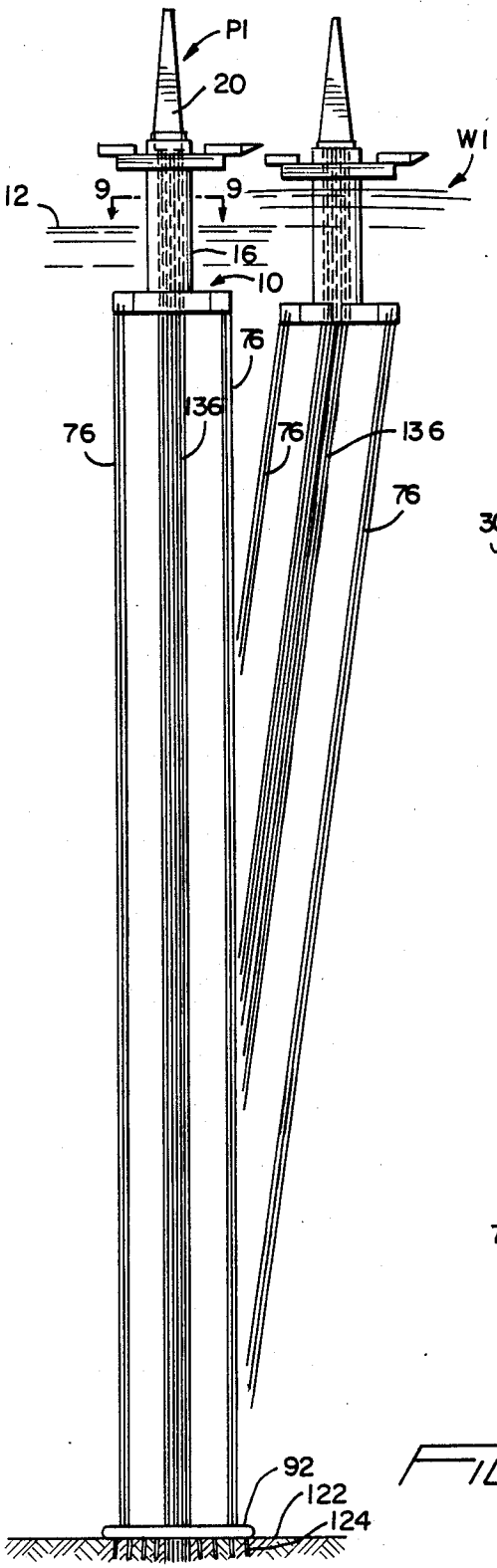
FIG. 9 is a cross-sectional view taken along the line 9—9 of FIG. 7 and viewed in the direction of the arrows.

Pontoon assembly 10, as best shown in FIGS. 3, 4 and 9, is X-shaped in plan and has equiangularly disposed legs 24, 26, 28 and 30 extending uniformly outwardly from the base of Column 16. Each of the legs 24, 26, 28 and 30 is rectangular in plan and cross-section, and the legs 24, 26, 28 and 30 have uniform dimensions, although other configurations are possible. Each of the legs 24, 26, 28 and 30 terminates in an end member 32, 34, 36 and 38, respectively, which is disposed generally transverse to the length dimension of the associated leg.

The legs 24, 26, 28 and 30 likewise have upper members 40, 42, 44 and 46, respectively, which lie on a common plane and are uniformly spaced from parallel lower members 48, 50, 52 and 54, respectively. Side leg members 56 and 58 extend between upper and lower members 40 and 48 and between column 16 and end member 32, while side leg members 60 and 02 complete leg 26.

Likewise, leg 28 has side leg members 64 and 66, while leg 30 has side leg members 68 and 70. The legs 24, 26, 28 and 30 are hollow and provide a multi-compartment ballast tank system for admitting sea water through valve 72 or causing same to be expelled as a result of air pressure supplied by a compressor or otherwise.

Figure 8:
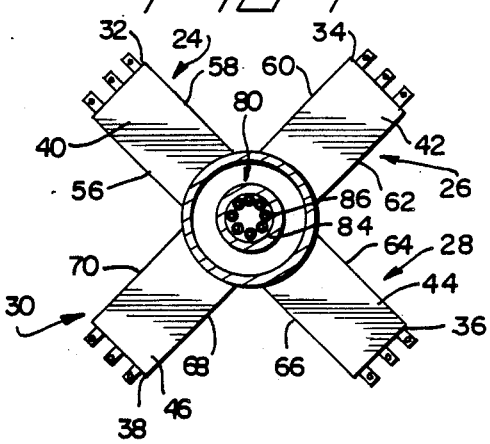
FIG. 8 is a fragmentary elevational view of the pontoon and tendon system of the invention.

A plurality of tendon receiving connector assemblies 74 are secured to each of the end members 32, 34, 36 and 38 adjacent the associated lower surfaces thereof, as best shown in FIGS. 8 and 9. The tendon receiving connector assemblies 74 are all substantially identical, and permit pivotal movement of a secured tendon 76. Those skilled in the art understand that the tendons 76 are long, multi-element tubular assemblies which are resilient but substantially non-elastic in the vertical direction. The tendon receiving connector assemblies 74 are uniformly spaced apart both relative to each other, and to the associated end members from which they depend.

Figure 2:
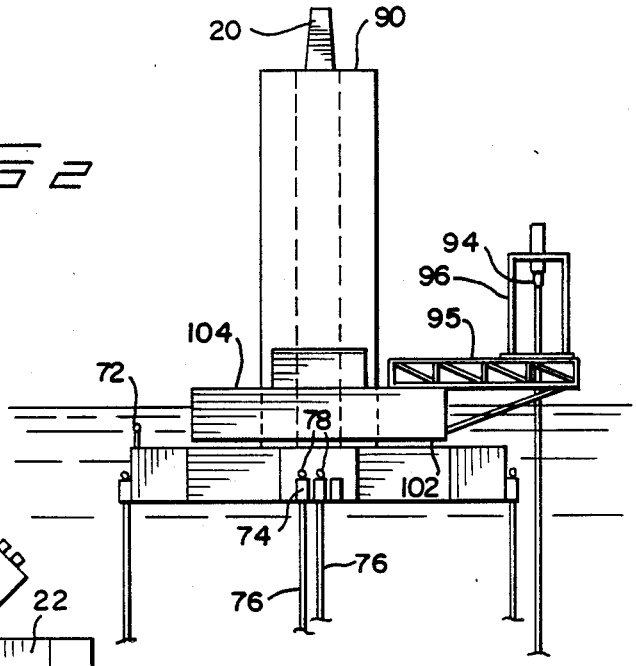
FIG. 2 is a fragmentary elevational view of the platform of FIG. 1 during installation of the tendons and with the platform in the transportation geometry.

It can be noted in FIG. 2 that a pivot connector 78, provided by a resilient bushing or the like, is mounted within or at the top of each of the tendon receiving connector assemblies 74 and is secured to the associated tendon 76 in order to permit pivoting of the tendons 76 during flexing thereof as may be caused by wind, wave or current conditions.

Cylindrical column 16 has an annular chamber 80 defined by outer wall 82 and inner cylindrical member 84 having central opening 86, as best shown in FIG. 9. Cylindrical column 16 and its annular chamber 80 are closed at the base thereof by end member 88, a best shown in FIG. 4, and at the upper end by end member 90, as best shown in FIG. 3. In this way, annular chamber 80 likewise provides a ballast tank system which, through valve 91 and in combination with pontoon assembly 10, permits the buoyancy of platform P1 to be regulated as may be needed.

FIG. 1 illustrates the platform P1 in the construction geometry. In this geometry, the work platform 18, which interiorly may include crew quarters, storage and the like, is lowered in order to be adjacent pontoon assembly 10 so that floatational stability is provided mainly by the pontoon assembly 10. Once deeper water is reached, then platform P1 may be appropriately ballasted so that pontoon assembly 10 is submerged, and platform 18 floats on surface 12, as best shown in FIG. 2. Stability in this transportation geometry is important because it is common for the platform P1 to be constructed at the shore, and to thereafter be towed or otherwise transported to the drill site. The drill site can be some distance from the shore, with the result that stability must be maintained for quite some period and distance, particularly during storms.

Figure 7:
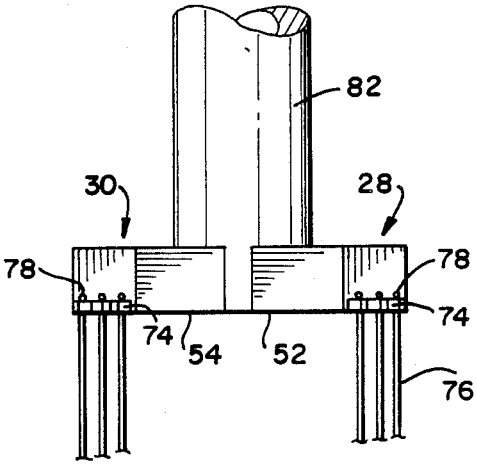
FIG. 7 is a schematic elevational view of the drilling platform of FIG. 1 in a second geometry and with the platform in the vertical and horizontally displaced

FIG. 7 discloses the platform P1 in the on-location geometry. In this geometry, the work platform 18 has been raised to an operating elevation along the column 16 relative to the pontoon assembly 10. Stability is provided by appropriate control of the ballasting of the chamber 80 and the pontoon assembly 10 so that the tendons 76, having substantial length and secured to and extending between pontoon assembly 10 and anchor 92, have a sufficient tension applied thereto. It can be noted in FIG. 7 that the platform assembly P1, as clearly illustrated on the right side thereof, has been horizontally shifted as a result of wave W1. The string-like effect of the tendons 76 permits the platform P1 to be horizontally shifted but substantially prevents upward and angular displacement, and also causes the platform to be returned to the vertical orientation illustrated on the left side of FIG. 7.

FIG. 2 illustrates the platform P1 in the transportation and installation geometry as the tendons 76 are suspended from hook 94 carried by crane assembly 96 secured to crane mount 95. Installation of the tendons 76 in the associated tendon receiving connector assemblies 74 can proceed fairly straightforwardly, because the pontoon assembly 10 is rotatable relative to the work platform 18. There is no pressure between the work platform 18 and the column 16, because both are floating on account of their own buoyancy. Receipt of a tendon 76 in one of the tendon receiving connector assemblies 74 and securement thereto by its pivot connector 78 can be rapidly effected. Rotation of the pontoon assembly 10 or the work platform 18 can then occur, in order to align the crane assembly 96 with the next tendon receiving connector assembly 74.

Figure 6:
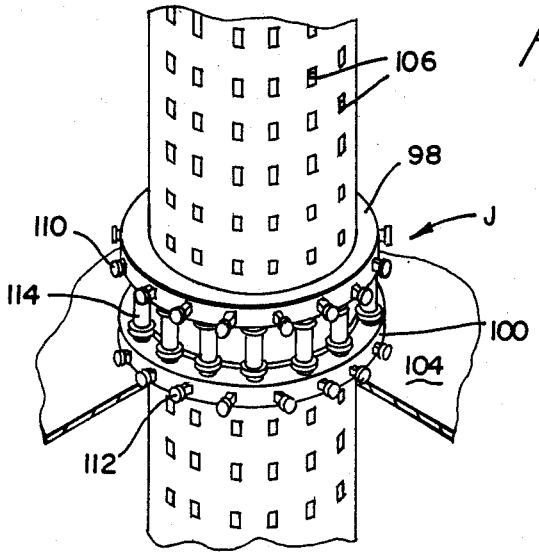
FIG. 6 is a fragmentary perspective view with portions broken away and in section of the jacking system of the invention.
Figure 5:
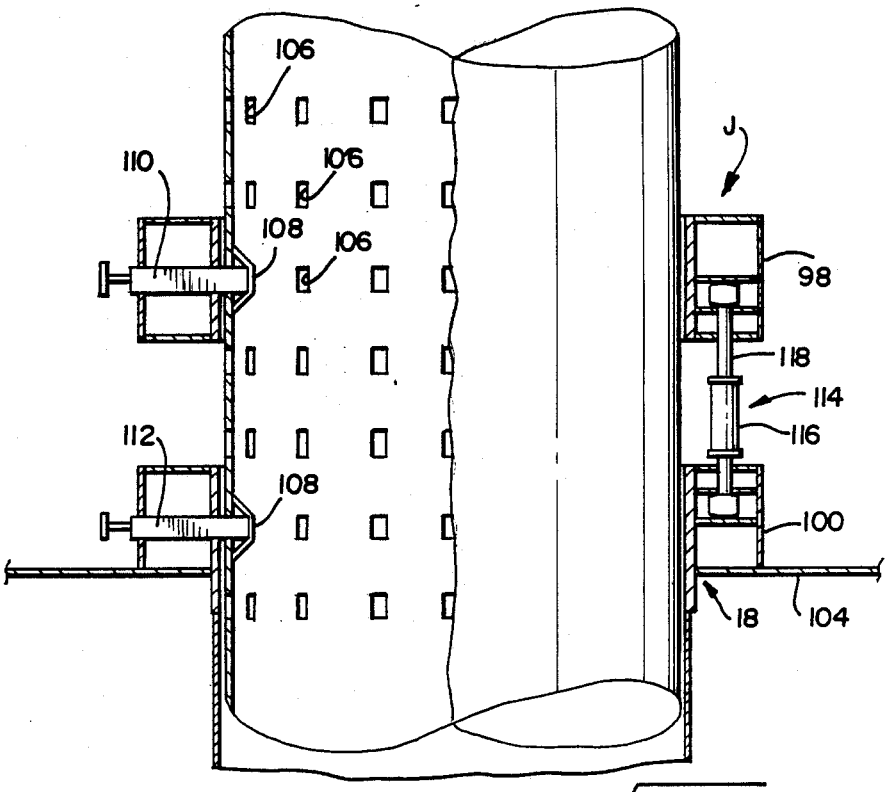
FIG. 5 is a fragmentary elevational view partially in section disclosing the jacking means of the invention.

Once the tendons 76 have all been mounted in their respective tendon receiving connector assemblies 74, then it is necessary to have the downwardly suspended ends thereof secured to the anchor 92, followed by jacking of the platform P1 into the second geometry illustrated in FIG. 7. FIGS. 5 and 6 illustrate the jack assembly J utilized for shifting the work platform 18 relative to the column 16 in order to cause the suspended ends of the tendons 76 to be positioned at or below the anchor 92, as well as to jack the work platform 18 to the elevated operating position once the tendons have been appropriately secured to the anchor 92 and the pontoon assembly 10 and chamber 80 deballasted. Since the work platform 18 is movable relative to the column 16, the upper end of the column 16 can be positioned substantially flush with the work platform 18. At this position, the derrick 20 may be moved in a position overlying the column 16, since the derrick 20 is movable on rails 21, as best shown in FIG. 3. Once the derrick 20 is overlying the column 16, the derrick 20 may be aligned with the central opening 86.

The jack assembly J is positioned on the top of the work platform 18 and comprises an upper annular yoke 98 mounted about the column 16 and free to slide along the column 16. A lower annular yoke 100 is similarly mounted about column 16 and is free to slide relative to the column 16. The yokes 98 and 100 have uniform inner and outer diameters, and the lower yoke 100 is secured to upper wall 104 of work platform 18. It is necessary that one of the yokes be secured to the work platform 18, while the other be free to move relative to the work platform 18.

A plurality of pin receiving openings 106 are equiangularly disposed about the column 16 for substantially the length thereof. The openings 106 are also disposed in a series of layers, with each layer having the same number of openings 106, and with the openings 106 of each layer longitudinally aligned with the openings 106 of the other layers. Each of the openings 106 is closed interiorly of the column 16 by a pin closure 108 in order to prevent the entry of water into chamber 80, as well as to prevent leakage from the chamber 80 and to maintain the proper ballast. In this way, each of the pin receiving openings 106 resembles a detent which is adapted for receiving an associated pin or jack element 110 or 112 carried by the yokes 98 and 100, respectively. There are sixteen sets of pins 110 and 112 disposed about the yokes 98 and 100 for assuring positive securement of the work platform 18 in a selected geometry, as well as to minimize the load on any individual pin 110 or 112 during jacking. While I have illustrated the pins 110 and 112 as being manually operable, those skilled in the art will understand that numerous mechanisms can be provided for driving the pins into the openings 106, as well as for removing them therefrom. It is preferred, however, that each of the pins 110 and 112 extend generally perpendicular to the axis of column 16 in order to minimize bending forces.

Interdigitated between the pins 110 of the yoke 98 and the pins 112 of the yoke 100 are a plurality of hydraulic cylinder and piston assemblies 114 The cylinders 116 thereof are secured to the yoke 100, and the pistons 118 thereof are secured within the yoke 98. In this way, extension and retraction of the pistons 118 will cause corresponding movement of the yokes 98 and 100 along the column 16, provided that the pins 110 or 112 of one of the yokes 98 and 100 are removed from the associated openings 106.

Movement of the work platform 18 along the column 16 can be readily accomplished by appropriate manipulation of the pins 110 and 112, in cooperation with extension and retraction of the cylinder and piston assemblies 114. Because the cylinder and piston assemblies 114 are secured to and extend between the yokes 98 and 100, then the weight of the work platform 18 will be carried by the yoke 98 as the yoke 100 is moved in response to operation of the cylinder and piston assemblies. In this way, once the pins 110 have been properly secured in their associated openings 106, then the pins 112 can be removed from their openings and the piston 118 caused to retract relative to the cylinder 116 so that the yoke 100 is caused to move toward the yoke 98, and thereby the platform 18 to be moved upwardly. Once the platform 18 has been moved sufficiently upwardly, then the pins 112 are inserted into their associated openings, and the pins 110 removed, thereby permitting the yoke 98 to again be moved upwardly relative to the yoke 100. After a sufficient distance, then the pins 110 are again inserted into their associated openings, and the process is repeated. Those skilled in the art will understand that the work platform 18 can similarly be moved downwardly through like cooperative action of the pins 110 and 112 with the cylinder and piston assemblies 114.

Figure 10:
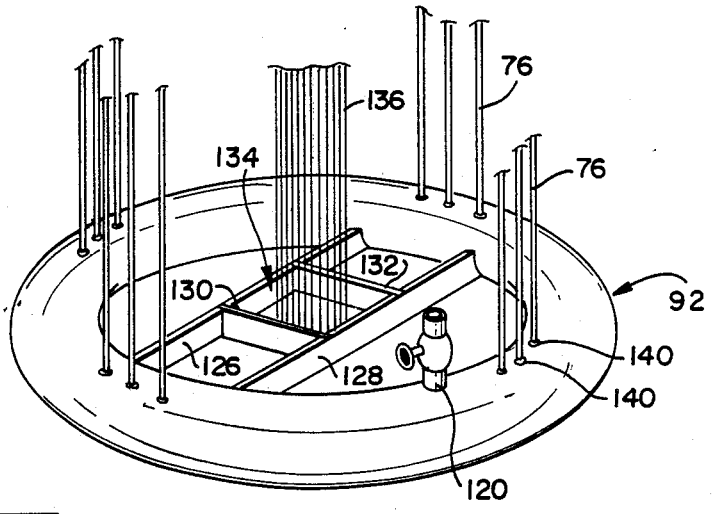
FIG. 10 is a perspective view of the anchor of the system with the tendons installed.

Anchor 92, as best shown in FIG. 10, is, preferably, a torus comprised of concrete having a hollow interior to which is connected valve 120. The anchor 92, because of the buoyancy provided by its hollow interior, will float on the surface of marine environment 14 and can therefore likewise be towed from shore to the drill site. Although configurations other than a torus are possible, I prefer a torus because it provides maximum strength for withstanding the pressures applied at extreme depths. Opening of the valve 120 will cause the anchor 92 to be filled with water such that the decreased buoyancy will cause the anchor 92 to sink to the sea floor 122, as best shown in FIG. 7. Anchor 92 may then be secured to the sea floor by suitable pilings, subterranean anchors and the like 124, although the weight of anchor 92 in certain instances may be sufficient to preclude the need for pilings 124.

Anchor 92 has girders 126 and 128 extending in spaced parallel relation from one side to the other. Beams 130 and 132 extend between the girders in order to form a box-like structure 134 through which risers 136 extend. The risers 136 extend upwardly from box structure 134 into aperture 86 of column 16 and are used to extract oil or gas, supply drilling fluids and the like. Preferably, each of the risers 136 has a pivot joint 138 slightly below end member 88, as best shown in FIG. 4, in order to permit the risers 136 to pivot as the platform P1 is shifted, as best shown in FIG. 7, and similar pivot joints may also be provided at anchor 92. Anchor 92 preferably has pivot joints 140, provided by resilient bushings or the like, for connecting the lower terminal end of each tendon 76 with the anchor 92. This prevents the respective tendon 76 from breaking during horizontal movement of the platform P1.

FIG. 15 discloses an alignment mechanism particularly useful during rotation of the work platform P during installation of the tendons 76. In this regard, ring 142 is secured to column 16 and fork 144 is slidably received within member 146 secured to platform 18. The fork 144 is movable generally transverse to the axis of column 16 with the result that engagement of the tines around the ring 142 prevents the column 16 from tipping or otherwise being shifted out of proper alignment. Conventional drive means 147 rotates the column 16 relative to the work platform 18, as best shown schematically in FIG. 15.

INSTALLATION OF PLATFORM P1

The platform P1, when configured in the geometry of FIG. 1, has sufficient stability to permit the platform P1 to be towed for a substantial distance from the shore. Once the water is sufficiently deep, then appropriate ballasting submerges the pontoon assembly 10 to the geometry of FIG. 2, and platform P1 remains in this geometry for the rest of the distance to the drilling location. Similarly, the anchor 92 likewise has sufficient buoyancy to permit it to be towed. Once the platform P1 has reached the location, however, then it is necessary to transform it to the on-site geometry illustrated in FIG. 7. The jacking system J permits this transformation to occur with relative ease, without sacrificing the stability attributable to a tension leg platform.

The anchor 92 is first caused to sink within marine environment 14 until it comes to rest on sea floor 122. Pilings 124 may then installed to secure the anchor 92 to the sea floor. After the anchor 92 is appropriately secured to the sea floor 122, then the tendons 76 are installed.

FIG. 2 illustrates the platform P1 during installation of the tendons 76 through utilization of the crane assembly 96. Each of the tendons 76 is appropriately secured within its associated tendon receiving connector assembly 74 and caused, thereby, to hang downwardly in marine environment 14. The tendons 76 are normally comprised of a series of interconnected pipe-like assemblies which together, necessarily, are quite long because the tension leg platform P1 is normally most suitable for water depths in excess of 500 feet.

Once all tendons 76 have been appropriately secured by pivot connectors 78 within their associated tendon receiving connector assemblies 74, then the pontoon assembly 10 may be jacked downwardly relative to surface 12 in order to cause the lower, suspended terminal ends of the tendons 76 to be disposed at or below the pivot joints 140 of the anchor 92. Appropriate manipulation of the pins 110 and 112 in combination with the cylinder and piston assemblies 114 will jack the column 16 and its pontoon assembly 10 relative to work platform 18, with the result that the pontoon assembly will be sufficiently further submerged.

The lower, suspended terminal ends of the tendons 76 may then be connected to the pivot joints 140. Once all tendons 76 have been appropriately secured to the anchor 92, then the platform P1 is shifted to the geometry of FIG. 7. This is accomplished by an upward stroke of the jacking assembly J in order to pull the platform 18 down into the water, thus creating a tension in the tendons 76. The specified initial design tension may then be achieved by pumping ballast from the pontoon assembly 10 and the column 16, as well as by simultaneously raising the platform 18 through appropriate manipulation of the jacking system J because the tendons 76 prevent the pontoon assembly 10 and column 16 from being moved vertically upward. Once the platform 18 has been jacked clear of the marine environment 14, and the ballast in the pontoon assembly 10 adjusted for proper initial tension of the tendons 76, then the platform 8 may be raised to its final design elevation through use of the jacking system J. Once at the operating elevation, then platform 18 is secured by the pins 112 of yoke 100 to column 16.

The single column platform P1 is an advantageous configuration because wind, wave and current forces are reduced on account of the reduced surface area of the single column 16. Furthermore, because of the central orientation of the column 16 relative to the pontoon assembly 10, the upper portions of the risers 136 are not exposed to wave forces because they pass upwardly through the aperture 86, and this aperture is normally submerged. The single column platform P1 is furthermore advantageous because of the X-shape of the pontoon assembly 10, and its ability to widely space the various groups of tendons 76. The tendons 76 are connected to the pontoon assembly 10 outwardly thereof such that, when the platform P1 is caused to be horizontally shifted on account of wave W1, as best shown in FIG. 7, then the tendons 76 are not struck or otherwise contacted by the pontoon assembly or related parts of the platform P1. This is also attributable to the fact that the tendon receiving connector assemblies 74 are positioned along the respective lower surfaces of the legs 24, 26, 28 and 30, and furthermore permit pivoting as may be required.

The single column platform P1 has improved performance not only because of the reduced surface area provided by the column 16, but also because the pontoon assembly 10 is appropriately dimensioned relative thereto to minimize turbulence, wave forces and the like which would occur as a wave W1 of substantial magnitude passed beyond the platform P1. As earlier noted, the relative dimensions of the column 16 to the pontoon assembly 10 can be appropriately selected so that the oppositely oriented buoyancy effects caused by the wave W1 are cancelled in a manner which enhances and increases stability.

FOUR COLUMN EMBODIMENT

Figure 11:
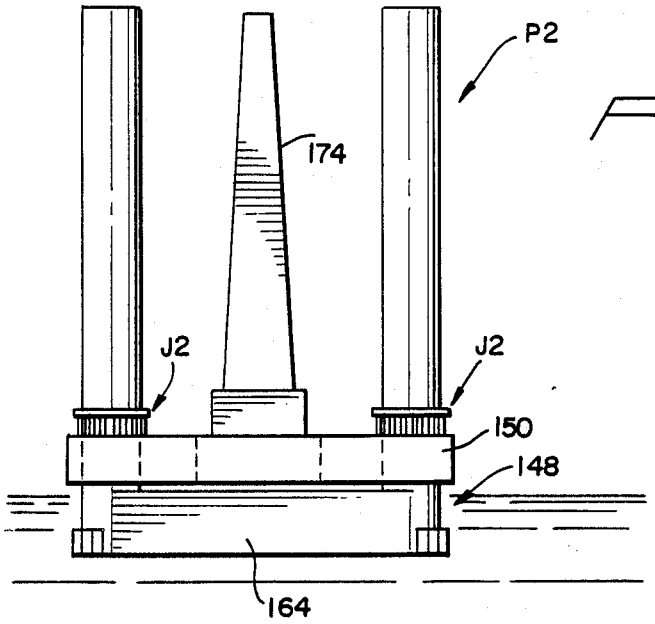
FIG. 11 is an elevational view with portions shown in phantom of a second embodiment of the invention floating on the surface of a marine environment in a first geometry.
Figure 12:
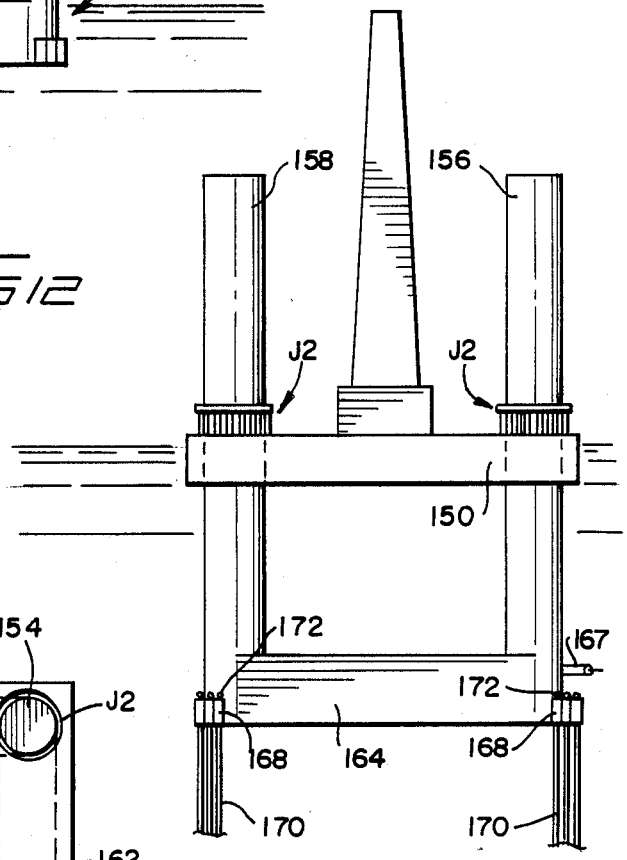
FIG. 12 is a fragmentary elevational view of the platform of FIG. 11 during the tendon connection phase.

FIGS. 11–14 illustrate a four column marine platform assembly P2 which utilizes a jack system J2, which corresponds to the jack system J, for shifting the pontoon assembly 148 and work platform 150 between the construction geometry of FIG. 11 the transportation geometry of FIG. 12 and the on-site geometry of FIG. 14. Platform P2 has columns 152, 154, 156 and 158 extending upwardly from pontoon assembly 148. The pontoon assembly 148 is a centrally open system, resulting from the interconnection of peripherally disposed hollow tubular legs 160, 162, 164 and 166 and has valve 167 for ballast control purposes.

Tendon receiving connector assemblies 168, which correspond to the tendon receiving connector assemblies 74 of the platform P1, are secured to the rounded, corner portions of the pontoon assembly 148 adjacent the associated lower surface thereof. The tendons 170, which correspond to the tendons 76 of the platform P1, are pivotally secured by pivot connections 172 within the associated tendon receiving connector assemblies 168. In this way, as with the platform P1, the tendons 170 are outwardly disposed relative to the pontoon assembly 148 in order to prevent them from being struck or otherwise contacted by the pontoon assembly 148 as the platform P2 is shifted from the normal, floating position illustrated to the left in FIG. 14, to the horizontally shifted position illustrated on the right side of FIG. 14.

Figure 13:
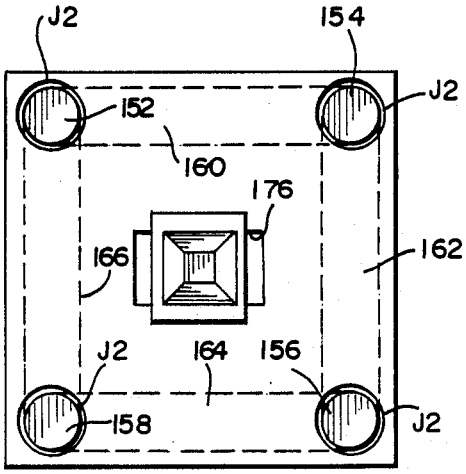
FIG. 13 is a top plan view of the platform of FIG. 11.

Platform P2 has a well derrick 174 which is secured to the work platform 150. The work platform 150 has a central opening 176, as best shown in FIG. 13, in order to permit risers 178 to extend upwardly from anchor 180, which corresponds to anchor 92 of platform P1, to the top of work platform 150. Because the legs 160, 162, 164 and 166 are spaced apart relative to each other, then there is a central opening in the pontoon assembly 148 which avoids the need for a pivot connector for the risers 178 prior to their passing through the pontoon assembly 148.

The platform P2 is connected to the anchor 180 much as discussed with the platform P1, with the exception that the platform 150 cannot rotate relative to the pontoon assembly 148 because of the four columns 152, 154, 156 and 158 which are fixed to and extend upwardly from the pontoon assembly 148. Once on location, however, the tendons 170 are secured within the associated tendon connector assemblies 168 and the pontoon assembly 148 is jacked by a plurality of jacking systems J2, each of which corresponds with the jack system J of the platform P1, and each of which is disposed about one of the columns 152, 154, 156 and 158 and carried by the platform 150.

FIG. 12 discloses the work platform 150 after it has been jacked intermediate the construction orientation of FIG. 11, and the operating orientation of FIG. 14. In this transportation and installation geometry, the tendons 170 are illustrated during the process of being lowered toward the anchor 180 in order to permit connection thereto.

Much as with the platform P1, the platform P2 has the work platform 150 normally disposed a substantial distance above the surface 182 of marine environment 184, as best shown in FIG. 14. Should a wave W2 pass through the platform P2, then the tendons 170 will again permit the platform P2 to be horizontally shifted relative to the normal vertical orientation, but will prevent upward and angular displacement. The columns 152, 154, 156 and 158 are sized relative to the pontoon assembly 148, as with the platform P1, in order to have the oppositely oriented buoyancy effects of the wave W2 cancelled in a manner which minimizes stress on the tendons 170.

While this invention has been described as having a preferred design, it is understood that it is capable of further uses, adaptations and/or modifications of the invention following in general the principle of the invention and including such departures from the present disclosure as come within known or customary practice in the art to which the invention pertains, and as may be applied to the central features hereinbefore set forth, and fall within the scope of the invention of the limits of the appended claims.

What is claimed is:

1. A mobile marine platform for operating at a deep-water site, comprising:

(a) horizontally disposed pontoon means for floating on or being submerged below the surface of a marine environment;

(b) at least a first vertically disposed column secured to said pontoon means and extending upwardly therefrom;

(c) a work platform having at least a first opening through which said column extends, said work platform overlying said pontoon means and vertically movable relative thereto along said column;

(d) jack means operably associated with said work platform and with said column for jacking said work platform relative to said column between a first position wherein said pontoon means and said work platform float on the marine environment while the platform is being moved to a site and a second position wherein said work platform is disposed above the surface of the marine environment and said pontoon means and a portion of said column are disposed below the surface of the marine environment;

(e) anchor means for being secured to the floor of the marine environment;

(f) a plurality of resilient tendons for extending between said pontoon means and said anchor means, said tendons for being under tension when said pontoon means and said column portion are below the surface of the marine environment so that wave and current induced horizontal movement of said pontoon means and thereby of said column and work platform is permitted and upward and angular movement thereof is resisted; and (g) said work platform being buoyant for providing with said pontoon means stability to the platform in the marine environment while the platform is being moved to the site, thereby permitting said column and said pontoon means to be sized so that stress on said tendons induced by wave action at the site is reduced.

2. The platform of claim 1, wherein:

(a) at least a first tendon receiving means is secured to and extends from a plurality of peripheral portions of said pontoon means; and, (b) at least a first second tendon receiving means is secured to and extends from a plurality of tendon receiving sites disposed about said anchor means, for each first tendon receiving means there is a second tendon receiving means.

3. The platform of claim 2, wherein:

(a) each of said first tendon receiving means includes means permitting a received tendon to pivot relative to the axis thereof; and, (b) each of said second tendon receiving means includes means permitting a received tendon to pivot relative to the axis thereof.

4. The platform of claim 3, wherein:

(a) said pontoon means have four peripherally disposed equiangularly spaced end members; and, (b) each of said first tendon receiving means is secured to one of said end members so that contact of a tendon by said pontoon means is prevented as said pontoon means are horizontally moved.

5. The platform of claim 3, wherein:

(a) said pontoon means are rectangular in plan and have four peripherally disposed and equiangularly spaced corner portions; and, (b) each of said first tendon receiving means is secured to one of said corner portions so that contact of a tendon with said pontoon means is prevented as said pontoon means are horizontally moved.

6. The platform of claim 2, wherein:

(a) said pontoon means have vertically spaced upper and lower surfaces; and, (b) said first tendon receiving means is secured proximate said lower surface.

7. The platform of claim 6, wherein:

(a) there are at least four equiangularly spaced peripheral portions disposed about said pontoon means; and, (b) there are at least three first tendon receiving means secured to each of said portions and the three first tendon receiving means of each portion are uniformly horizontally spaced.

8. The platform of claim 1, wherein:

(a) said jack means are secured to said work platform.

9. The platform of claim 8, wherein said jack means includes:

(a) a first annular upper yoke disposed about said column and including a plurality of first jack elements extending generally transverse to the axis of said column and each of said first jack elements is movable for selectively engaging said column and locking said first yoke relative thereto;

(b) a second annular lower yoke is disposed about said column and includes a plurality of second jack elements extending generally transverse to the axis of said column and each of said second jack elements is movable for selectively engaging said column and locking said second yoke relative thereto;

(c) a plurality of third jack elements extends between said first and second yokes generally parallel to the axis of said column, each of said third jack elements includes means for moving one of the yokes along said column relative to the other and, (d) one of said yokes is secured to said work platform so that operation of said means for moving causes said work platform to move along said column.

10. The platform of claim 9, wherein:

(a) a plurality of vertically spaced series of jack element receiving openings are disposed about said column, each opening of a series is aligned with one of said first and second jack elements;

(b) each of said first jack elements is aligned with one of said second jack elements; and, (c) each of said first and second jack elements has a portion positionable in an aligned jack receiving opening for thereby fixing the associated yoke relative to said column.

11. The platform of claim 10, wherein:

(a) the openings of a series are equiangularly disposed about said column.

12. The platform of claim 9, wherein:

(a) each of said third jack elements includes a cylinder and piston assembly, the cylinder thereof is secured to one of said yokes and the piston thereof is secured to the other of said yokes.

13. The platform of claim 12, wherein:

(a) each of said third jack elements is interposed between a pair of said first and second jack elements.

14. The platform of claim 10, wherein:

(a) a pin hole closure pan is positioned within said column overlying each of said openings for sealing the associated opening.

15. The platform of claim 4, wherein:

(a) said column extends centrally from said pontoon means.

16. The platform of claim 15, wherein:

(a) tower means are carried by said work platform and extend upwardly therefrom, said tower means being movable on said work platform relative to said column for overlying said column when said pontoon means are in said second position and for being spaced from said column when said pontoon means are in said first position.

17. The platform of claim 16, wherein:

(a) said column has a centrally disposed aperture extending therethrough; and, (b) said tower means is aligned with said aperture when said tower means overlies said column.

18. The platform of claim 15, wherein:

(a) said column and said pontoon means each includes means for selectively admitting thereto the surrounding marine environment for ballasting the assembly.

19. The platform of claim 15, wherein:

(a) said column is rotatable relative to said work platform; and, (b) means are carried by said work platform and cooperate With said column for maintaining orientation of said column relative to said work platform during rotation of one relative to the other.

20. The platform of claim 19, wherein:

(a) said maintaining means includes a fork carried by said work platform; and, (b) a ring extends about said column and is receivable in said fork for maintaining orientation of said column relative to said work platform.

21. The platform of claim 5, wherein:

(a) there are at least four columns extending from said pontoon means, each of said columns proximate a corner of said pontoon means;

(b) at least four openings are disposed in said work platform, each of said openings is aligned with one of said columns and through which the associated column extends; and, (c) there are at least four jack means associated with said work platform, each of said jack means is operably associated with one of said columns.

22. The platform of claim 5, wherein:

(a) said anchor means is an hollow anchor assembly; and, (b) means are operatively associated with said anchor assembly for selectively admitting the surrounding environment thereto so that buoyancy of said anchor assembly may be regulated.

23. The platform of claim 22, wherein:

(a) said anchor assembly is a torus.

24. A well drilling assembly for operating at a deepwater site, comprising:

(a) a floating platform comprising pontoon means submerged below the surface of a marine environment, at least a first vertically disposed column secured to said pontoon means and extending upwardly therefrom and terminating above the marine environment, a work platform having at least a first opening through which said column extends and said work platform overlies said pontoon means and is movable along said column relative thereto, and jack means operatively associated with said work platform and with said column for jacking said work platform along said column between a first position wherein said pontoon means and said work platform float on the marine environment and a second position wherein said pontoon means and a portion of said column are submerged therebelow and said work platform is disposed at a distance thereabove;

(b) anchor means secured to the floor of the marine environment;

(c) a plurality of resilient tendons extending under tension between and secured to said anchor means and said pontoon means so that wave and current induced horizontal movement of said platform is permitted and upward and angular movement thereof is resisted;

(d) whereby said work platform in said first position provides with said pontoon means stability to the platform in the marine environment while the platform is being moved to a site, thereby permitting said column and said pontoon means to be sized so that stress on said tendons induced by wave action at the site is reduced.

25. The assembly of claim 24, wherein:

(a) said column is cylindrical and extends centrally from said pontoon means.

26. The assembly of claim 24, wherein:

(a) said pontoon means have four equiangularly disposed end sections; and, (b) each of said tendons is pivotally connected to one of said end sections so that contact of said pontoon means with said tendons during horizontal movement of said platform is avoided.

27. The assembly of claim 26, wherein:

(a) said pontoon means have vertically spaced upper and lower major surfaces; and, (b) said tendons are pivotally connected proximate said lower surfaces.

28. The assembly of claim 24, wherein:

(a) said pontoon means includes a plurality of ballast tank means;

(b) said column includes ballast tank means; and, (c) means are operably associated with the ballast tank means of said column and pontoon means for selectively admitting sea water thereto for regulating the buoyancy of said platform.

29. Jack-up tension leg platform for operating at a deepwater site, comprising:

(a) a generally horizontally disposed pontoon means for floating on or being submerged below the surface of a marine environment, said pontoon means being X-shaped in plan;

(b) a first vertically disposed cylindrical column secured centrally to said pontoon means and extending upwardly therefrom;

(c) a work platform having a central opening therethrough and through which said column extends, said work platform overlying said pontoon means and is vertically movable relative thereto along said column; and, (d) jack means operatively associated with said work platform and with said column for jacking said work platform between a first position wherein said pontoon means and said work platform float on the marine environment and a second position wherein said pontoon means are submerged therebelow and said work platform is disposed at a distance thereabove (e) whereby said work platform in said first position provides with said pontoon means stability to the platform in the marine environment while the platform is being moved to a site, thereby permitting said column and said pontoon means to be sized so that stress on said tendons induced by wave action at the site is reduced.

30. The platform of claim 29, wherein said jack means included:

(a) an upper annular yoke mounted about and longitudinally movable along said column, said upper yoke including a plurality of first jack elements selectively engageable with said column for fixing said upper yoke relative to said column;

(b) a lower annular yoke mounted about and longitudinally movable along said column, said lower yoke including a plurality of second jack elements selectively engageable with said column for fixing said lower yoke relative to said column;

(c) a plurality of third jack elements secured to and extending between said yokes and each third jack element adapted for moving one yoke relative to the other when one of said yokes is fixed to said column; and, (d) one of said yokes secured to said platform so that movement of the associated yoke causes movement of said platform.

31. The platform of claim 30, wherein:

(a) said first jack elements lie on a first plane and said second jack elements lie on a second parallel plane, and there is a first jack element for each second jack element.

32. The platform of claim 31, wherein:

(a) a plurality of openings are disposed in said column, and said openings are disposed in a plurality of longitudinally spaced and aligned series with each opening of a series aligned with one of said jack elements; and, (b) each jack element has a portion positionable in an aligned one of said openings in order to fix the associated yoke thereto.

33. The platform of claim 30, wherein:

(a) said first and second jack elements extend generally transverse to the axis of said column; and, (b) said third jack elements extend parallel to the axis of said column.

34. The platform of claim 33, wherein:

(a) each third jack element is interdigitated between associated pairs of said first and second jack elements.

35. The platform of claim 29, wherein:

(a) said column and said pontoon means are substantially hollow; and, (b) means are operably associated with said column and said pontoon means for admitting sea water thereto for regulating the buoyancy thereof

36. The platform of claim 29, wherein:

(a) said column has a centrally disposed aperture therethrough; and, (b) a drilling mast is mounted to said work platform and is adapted for being moved between a first position aligned with said aperture and a second position spaced therefrom.

37. The method of installing a tension leg platform for operating at a deepwater site comprising a horizontally disposed pontoon means for floating on or being submerged below the surface of a marine environment, at least a first vertically disposed column secured to said pontoon means and extending upwardly therefrom, a work platform having at least a first opening through which said column extends, said work platform overlying said pontoon means and vertically movable relative thereto along said column, anchor means for being secured to the floor of the marine environment, and a plurality of resilient tendons, said method comprising the steps of:

(a) positioning the platform adjacent the pontoon means such that the work platform and the pontoon means float on the marine environment to thereby provide a stable geometry for towing of the platform to a site;

(b) towing the platform to the site;

(c) securing the anchor means to the floor of the marine environment;

(d) securing each of the tendons to the pontoon means so that the tendons are suspended therefrom in the marine environment and terminate a selected distance above the anchor means;

(e) lowering the pontoon means below the surface of the marine environment and thereby causing the tendons to terminate at or below the anchor means;

(f) connecting the tendons to the anchor means;

(g) increasing the buoyancy of the pontoon means so that tension is applied to the tendons; and (h) raising the work platform above the surface of the marine environment to thereby minimize the forces acting on the platform due to wave action.

* * * * *